US007614193B2

(12) United States Patent
Turner et al.

(10) Patent No.: US 7,614,193 B2
(45) Date of Patent: Nov. 10, 2009

(54) UNDERLAYMENT FOR TILE SURFACE

(75) Inventors: Brian H. Turner, Walton, KY (US); Vernon Kallenborn, Walton, KY (US)

(73) Assignee: Tilediy, LLC, Walton, KY (US)

( * ) Notice: Subject to any disclaimer, the term of this patent is extended or adjusted under 35 U.S.C. 154(b) by 457 days.

(21) Appl. No.: 10/973,480

(22) Filed: Oct. 26, 2004

(65) Prior Publication Data

US 2006/0096208 A1 May 11, 2006

(51) Int. Cl.
*E04F 13/08* (2006.01)

(52) U.S. Cl. ..... 52/385; 52/386; 52/389; 52/390

(58) Field of Classification Search ..... 52/386, 52/389, 385, 384, 375, 376, 346, 347, 390, 52/391, 403.1
See application file for complete search history.

(56) References Cited

U.S. PATENT DOCUMENTS

| | | | | | |
|---|---|---|---|---|---|
| 658,868 | A | * | 10/1900 | Rosenbaum | 52/387 |
| 1,106,168 | A | * | 8/1914 | Thomas | 52/387 |
| 1,778,345 | A | | 10/1930 | Venzie | |
| 1,930,024 | A | | 10/1933 | Varden | 72/116 |
| 2,193,231 | A | | 3/1940 | Gibbons | 80/60 |
| 2,345,221 | A | * | 3/1944 | Swenson | 52/409 |
| 3,527,004 | A | | 9/1970 | Sorensen | 52/98 |
| 3,533,896 | A | | 10/1970 | Hartig | 161/100 |
| 3,602,476 | A | * | 8/1971 | Iragorri | 249/96 |
| 3,731,445 | A | * | 5/1973 | Hoffmann et al. | 52/391 |
| 4,318,258 | A | | 3/1982 | Heck | 52/309 |
| 4,651,487 | A | | 3/1987 | Nishikawa | 52/378 |
| 4,890,433 | A | * | 1/1990 | Funaki | 52/386 |
| 4,932,182 | A | * | 6/1990 | Thomasson | 52/318 |
| 5,052,161 | A | * | 10/1991 | Whitacre | 52/385 |
| 5,111,627 | A | * | 5/1992 | Brown | 52/126.5 |
| 5,232,608 | A | * | 8/1993 | Mayer | 249/96 |
| 5,255,482 | A | * | 10/1993 | Whitacre | 52/390 |
| 5,816,005 | A | | 10/1998 | Han | 52/391 |
| 5,822,937 | A | * | 10/1998 | Mahony et al. | 52/366 |
| 5,924,252 | A | * | 7/1999 | Deike | 52/390 |
| 5,927,033 | A | * | 7/1999 | Kreckl | 52/390 |
| 5,956,921 | A | | 9/1999 | Fleck et al. | 52/741.3 |
| 6,041,567 | A | * | 3/2000 | Passeno | 52/749.11 |
| D429,347 | S | | 8/2000 | Doyle et al. | D25/124 |

(Continued)

FOREIGN PATENT DOCUMENTS

JP 04016661 A * 1/1992

OTHER PUBLICATIONS

*Are Hybrid Designs the Future for Composite Bridge Decks?*, Composites Technology, Feb. 2004, pp. 20-25.

*Primary Examiner*—Richard E Chilcot, Jr.
*Assistant Examiner*—Ryan D Kwiecinski
(74) *Attorney, Agent, or Firm*—Wood, Herron & Evans, L.L.P.

(57) ABSTRACT

A fiber-reinforced pultruded underlayment for ceramic tile includes a thin base with a plurality of elongated ridges. The underlayment is in the form of planks having interlocking tongue and groove edges. The elongated ridges have a narrow base and a wider distal portion wherein the areas between adjacent ridges have a trapezoidal cross sectional configuration. Tile is adhered to the surface using a rigid cementitious or epoxy adhesive which fills in the trapezoidal area creating a very rigid support structure for the ceramic tile.

6 Claims, 3 Drawing Sheets

U.S. PATENT DOCUMENTS 6,122,890 A * 9/2000 Pollitt ..... 52/747.11
6,161,353 A 12/2000 Negola et al. ..... 52/453
6,164,037 A * 12/2000 Passeno ..... 52/749.11
6,167,668 B1 1/2001 Fine et al. ..... 52/403.1
6,305,135 B1 * 10/2001 Inaba ..... 52/309.12
6,381,793 B2 * 5/2002 Doyle et al. ..... 14/73
6,539,643 B1 4/2003 Gleeson ..... 33/563
6,543,196 B1 * 4/2003 Gonzales ..... 52/386
6,579,413 B1 6/2003 Grove ..... 162/145
6,631,598 B2 * 10/2003 Raineri ..... 52/385
6,951,086 B2 * 10/2005 Passeno ..... 52/386
7,121,051 B2 * 10/2006 Hunsaker ..... 52/314
2001/0037533 A1 * 11/2001 Doyle et al. ..... 14/73
2003/0046779 A1 * 3/2003 Dumlao et al. ..... 14/2.4
2003/0074853 A1 4/2003 Potter ..... 52/403.1
2004/0216250 A1 * 11/2004 Dumlao et al. ..... 14/73
2006/0201092 A1 * 9/2006 Saathoff et al. ..... 52/385
2008/0107871 A1 * 5/2008 Richards ..... 428/167

* cited by examiner

UNDERLAYMENT FOR TILE SURFACE

BACKGROUND OF THE INVENTION

Ceramic tile is an excellent floor covering. It is very durable and generally easy to clean. However, ceramic tile is also extremely brittle. Therefore, when it is positioned on a floor it must have a subsurface that does not flex. This can be, for example, a concrete surface or a cementitious underlayment such as Wonderboard. Materials such as wood, including plywood and particle board are generally unacceptable.

Obviously, cement cannot be used in all applications. The cementitious board is heavy and difficult to cut.

SUMMARY OF THE INVENTION

The present invention is premised on the realization that a pultruded plank having elongated ridges or ribs can be utilized as an underlayment material for tile. In particular, this pultruded plank forms an excellent underlayment for outdoor decks enabling one to cover a wood deck surface with tile. The objects and advantages of the present invention will be further appreciated in light of the following detail description and drawings in which:

DETAILED DESCRIPTION OF THE INVENTION

Figure 1:
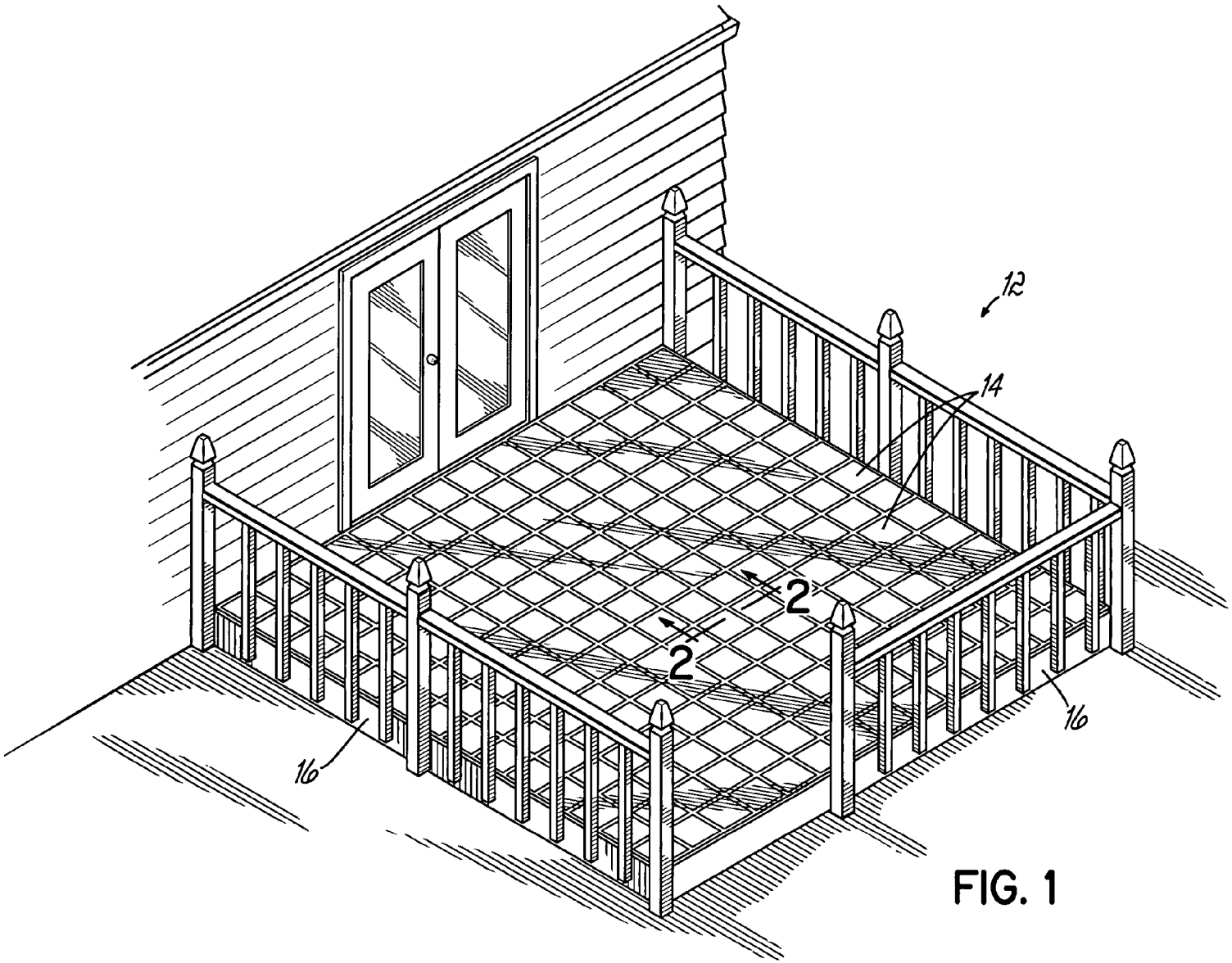
FIG. 1 is a perspective view of a deck surface according to the present invention.
Figure 2:
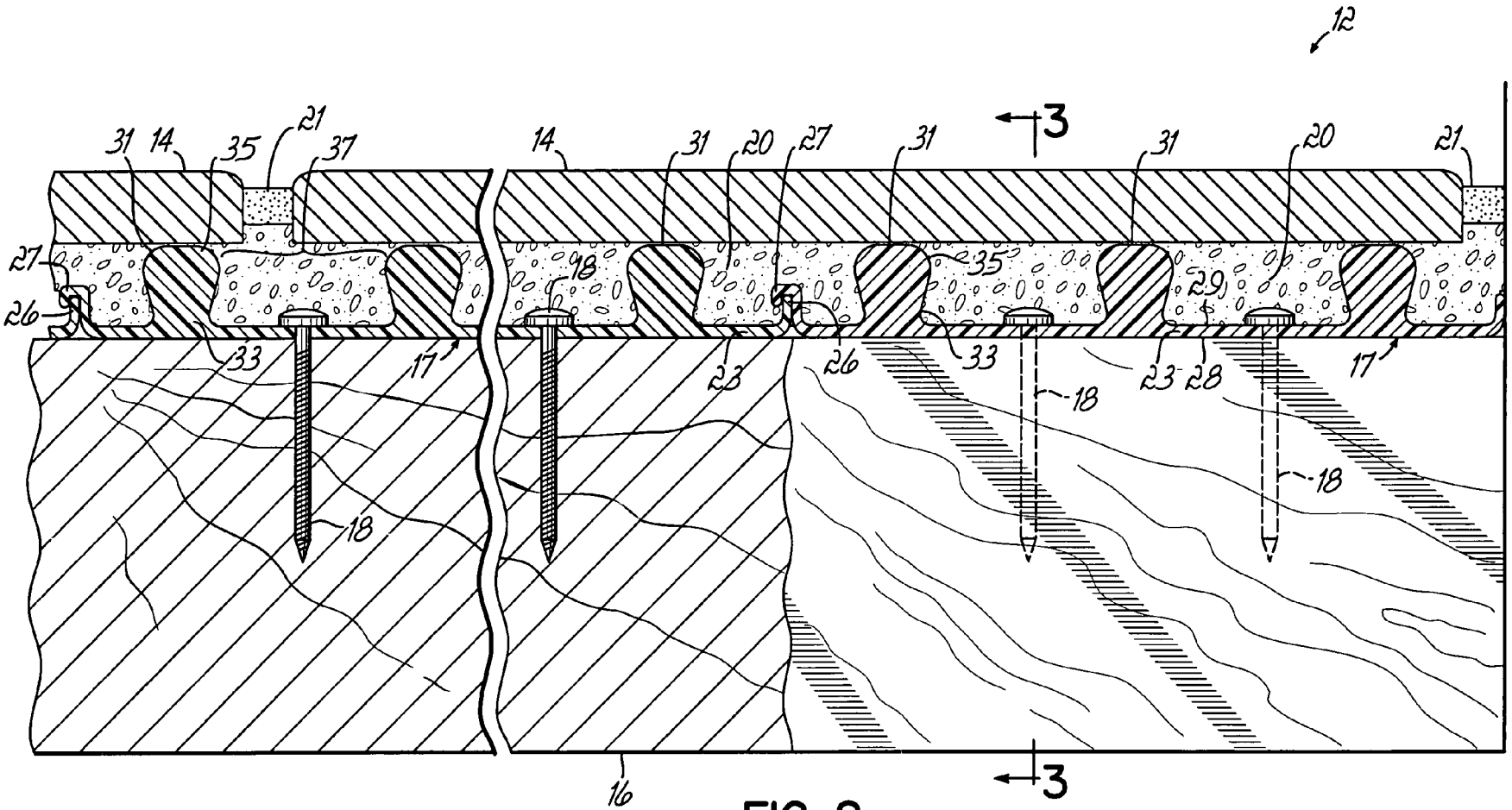
FIG. 2 is a cross sectional view taken at lines 2-2 of FIG. 1.
Figure 3:
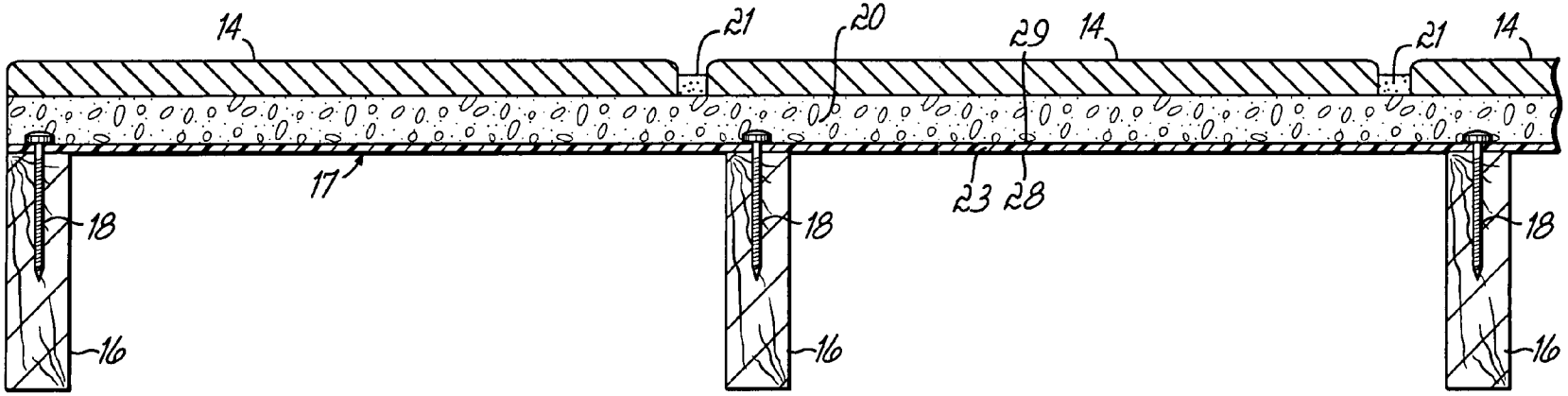
FIG. 3 is a cross sectional view taken at lines 3-3 of FIG. 2.
Figure 4:
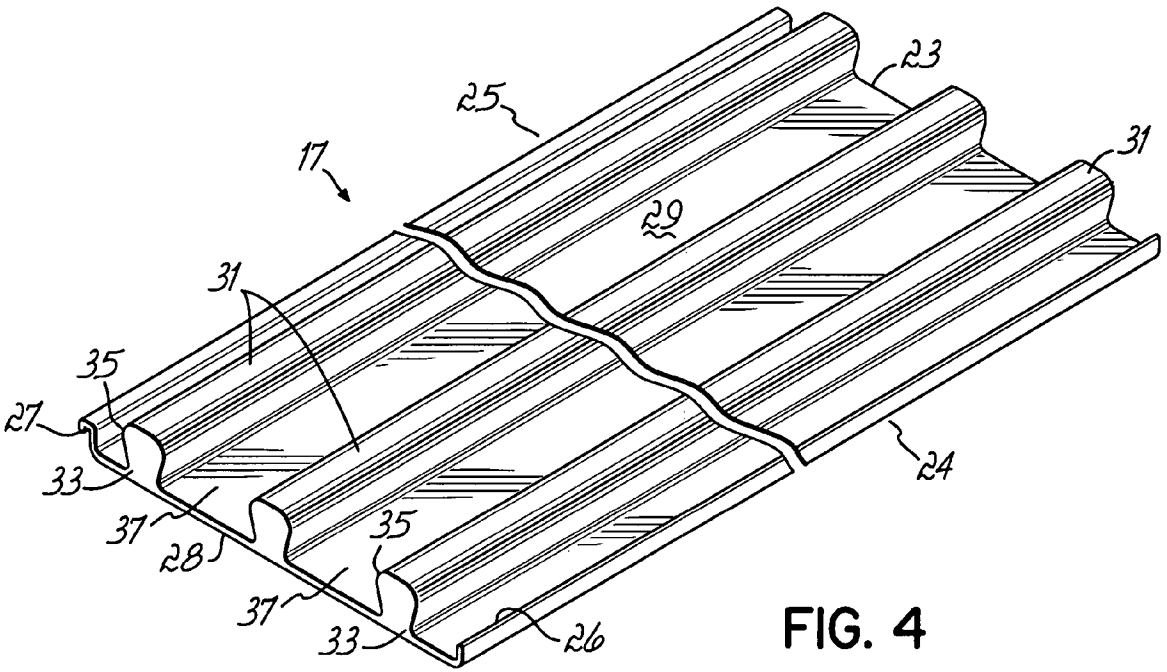
FIG. 4 is a perspective view of the pultruded plank of the present invention.

As shown in FIGS. 1-4, the present invention includes a deck 12 (as shown attached to a house) which is covered with tile 14. The deck itself is of typical construction formed from beams such as wood beams 16 which are, in turn, covered with pultruded planks 17 fastened to the beams with penetrating fasteners such as screws 18 (as shown) or nails, and the like. A cementitious adhesive layer 20, commonly referred to as Thinset®, is used to adhere the tile 14 to the pultruded planks 17. The area between the individual tiles 14 is filled with grout 21.

The planks 17, as indicated, are preferably fiber-reinforced pultruded planks. Preferably, the pultruded plank 17 is formed from a thermo setting polyester resin with about 25%-70% by volume fiberglass filler. Preferably, the fiberglass is 50% by volume (65% by weight). This has a high modulus of elasticity and high tensile strength. However, other rigid polymers, such as certain nylons that can withstand temperature variations, can also be employed in the present invention.

These planks include a base 23 having a first side 24 and a second side 25. As shown, the first side edge 24 bends upwardly to form a tongue 26, and the second side 25 includes a curled edge 27 which forms a groove. The respective tongues and grooves of adjacent planks interlock.

The base 23 has a flat bottom surface 28 and an upper surface 29. Extending along the upper surfaces are a plurality of elongated ridges 31. These ridges have a relatively narrow base 33 and a wider distal portion 35. The area 37 between adjacent ridges has a trapezoidal cross sectional configuration.

The base itself is relatively thin, being from about 1/32 to about 1/4 inch thick with about 1/16 of an inch being preferable. The ridges can extend above the base up to 1/2 inch, with about 3/8 inch being preferred. The dimensions would obviously vary depending upon the application. Typically a 1/16 inch base with a ridge extended 3/8 inch above the base is adequate for spanning beams positioned at 16 inches on center. The base of the ridge will be narrower than the top of the ridge. The base of the ridge may be 1/8 to 1/2 inch, preferably 1/4 inch. The top of the ridge should be 1/8 to 1/4 inch wider than the base of the ridge. The spacing between ridges at their base should be 1/2 to 2, with 1 inch preferred.

The width from side to side is a matter of choice. It can be as narrow as 4 inches or as side as several feet. Likewise, the length is a matter of choice. Generally, these will be at least 12 feet or longer.

To apply a tile surface 14 to a deck structure as shown in the figures, one simply places the planks 17 on the beams 16 with the tongue and groove of adjacent planks interlocked. Screws or nails 18 extend through the base into the deck beams. However, it is possible to not use fasteners and allow the planks to float on the beams.

Once the deck is covered, the trapezoidal areas 37 are filled with a hardening floor tile adhesive material with sufficient adhesive to extend slightly above the upper surface 35 of the ridges, and to fill in the trapezoidal areas 37. A commercially available product is Thinset®, which is a cementitious product. An epoxy based tile adhesive will also work. Tiles 14 are then positioned on the planks and pressed into contact with the cementitious adhesive 20. The adhesive is allowed to set and the tiles are permanently adhered to the planks 17. Grout 21 is applied between adjacent tiles to form the finished deck.

The pultruded planks of the present invention are easy to install and can be cut to desired lengths with a circular saw. Holes can be easily drilled using ordinary wood drill bits, to provide clearance for water pipes, and the like, making this much easier to apply than cementitious boards. Further, it is very dimensionally stable over a wide temperature range. They can be used inside over particle board or outside as part of a tile covered deck.

Because of the trapezoidal areas between the ridges, the cementitious or epoxy adhesive actually provides the strength and rigidity. Further, the dimensions of the ridges can be varied. Very thin ridges could be used if the tile surface is a wall. But, preferably, the plank will have longer ridges for use as flooring.

This has been description of the present invention along with the preferred method of practicing the present invention. However, the invention itself should only be defined by the appended claims, Wherein We claim:

1. A tiled floor structure comprising a plurality of elongated fiber reinforced polymeric planks aligned side-by-side over a horizontal base support;

said planks having a first and a second side, a thin base connecting said sides, a plurality of elongated solid ridges extended above said base and extending along a length of said planks establishing open areas there between;

said planks having a height measured from said base to an upper surface of said ridges being from about 13/32 inch to about 3/4 inch wherein said horizontal base support comprises a plurality of floor joists and a plurality of fasteners extended through said planks into said joists fastening said planks to said joists;

a hardening floor tile adhesive material covering said base and filling said areas between said ridges; and a tile layer adhered to said upper surface of said ridges with said entire tile layer above said ridges.

2. The tiled structure claimed in claim 1 wherein said plank is a fiber reinforced pultruded plank.

3. The tiled structure claimed in claim 2 wherein said ridges have a base and a top surface wherein said top is wider than said base.

4. The tiled structure claimed in claim 3 wherein said planks include at least three elongated ridges.

5. The tiled structure claimed in claim 3 wherein said first side has a tongue structure and said second side has a groove structure wherein adjacent planks are adapted to inter-fit with respective tongues and grooves.

6. The tiled structure claimed in claim 1 wherein said tiled structure is an outdoor deck.

* * * * *